United States Patent [19]

Bender

[11] 4,310,745

[45] Jan. 12, 1982

[54] HEATING ASSEMBLIES

[75] Inventor: Joseph Bender, Winnipeg, Canada

[73] Assignee: Huebner Bros. of Canada Ltd., Winnipeg, Canada

[21] Appl. No.: 97,559

[22] Filed: Nov. 26, 1979

Related U.S. Application Data

[63] Continuation-in-part of Ser. No. 32,099, Apr. 20, 1979, abandoned, which is a continuation-in-part of Ser. No. 794,359, May 6, 1977, abandoned.

[51] Int. Cl.[3] ..... H05B 1/00

[52] U.S. Cl. ..... 219/213; 219/345; 219/347; 219/538; 219/548; 338/280

[58] Field of Search ..... 219/213, 345, 347, 382, 219/385, 522, 528, 538, 541, 548, 549, 552, 544; 338/212, 280, 283, 284, 286, 287, 291; 174/117

[56] References Cited

U.S. PATENT DOCUMENTS

| | | | |
|---|---|---|---|
| 600,057 | 3/1898 | Ball | 338/280 |
| 2,530,806 | 11/1950 | Boxrud | 338/280 |
| 2,540,295 | 2/1951 | Schreiber | 219/213 |
| 2,790,889 | 4/1957 | Hynes | 338/280 X |
| 2,889,445 | 6/1959 | Wolf | 219/345 |
| 3,086,187 | 4/1963 | Duggan et al. | 338/283 |
| 3,136,885 | 6/1964 | Hynes | 219/382 |
| 3,260,835 | 7/1966 | Soukey et al. | 219/213 |
| 3,265,865 | 8/1966 | Hager, Jr. | 219/549 |
| 3,317,657 | 5/1967 | Eisler | 174/117 |
| 4,032,751 | 6/1977 | Youtsey et al. | 219/538 |

*Primary Examiner*—Volodymyr Y. Mayewsky
*Attorney, Agent, or Firm*—Stanley G. Ade

[57] ABSTRACT

A heating strip or film panel is connectable to a source of electrical power and is sandwiched between one or more facing panels of flexible or rigid material, and when connected to a source of electrical power, radiate heat from one or both sides. In one embodiment, insulation and a reflective sheet may be incorporated so that one side of the assembly remains cool and the other radiates heat. If required, the assembly may be used in any location requiring heat and in which the panels can be mounted such as in walls, ceilings, floors and the like. In another embodiment, the panels are flexible and can be wrapped around the object to be heated. If desired, the panel can be molded into a helment shaped configuration and can be used, for example, as a hair dryer and another embodiment, a flexible panel can be routed around dowels to give an increased cross sectional heat source area as compared with a planar sheet.

8 Claims, 12 Drawing Figures

HEATING ASSEMBLIES

BACKGROUND OF THE INVENTION

This invention relates to electrical heat strip or film assemblies utilizing, for example, a film illustrated and described in U.S. Pat. No. 3,865,626, and constitutes a continuation-in-part application of Ser. No. 32,099, filed Apr. 20, 1979 (now abandoned) which in turn was a continuation-in-part application of Ser. No. 794,359, filed May 6, 1977 (now abandoned).

Basically the heat strip or film used consists of laminated synthetic plastic films or sheets which are flexible and between which is incorporated electrical conductive resistive material. By varying the quantity of material sandwiched between the flexible plastic film, varying wattages can be produced. A copper or other conducting strip is situated on each side edge of the film which enables connection to be made to a source of electrical power.

SUMMARY OF THE INVENTION

In the present invention a construction is shown and described which incorporates a facing material, the electrical heat strip or film, insulating material, a reflective film and a support substrate or combinations thereof.

One aspect of the invention permits the heat to be directed to one side of the structure form (which may be flexible or rigid) and prevents the escape of heat from the other side, depending upon the degree of insulation and the reflective capabilities of the reflective film.

Another aspect of the invention incorporates the heat strip or film between two facing materials which may be flexible or rigid, thus giving two warm sides to the structure rather than one warm side and one cold side.

The preferred embodiment contemplates a wall or ceiling panel consisting of a sheet of the heat strip or film which is formed or guided into a corrugation having a panel on one side which becomes the warm side, and a wall panel and reflective panel on the other which becomes the cold side, all of the panels being secured together by adhesive or the like to form a sandwiched wall panel which incorporates a source of heat in the form of the heat strip or film and which can be used in many locations, not only as a decorative wall or ceiling panel, but also as a heating panel. Alternatively, it can be utilized as a floor heating panel if desired.

In accordance with the invention there is provided a heating assembly for use with a source of electrical power and comprising in combination a panel construction including a heat film panel and a facing material panel on at least one side thereof, means to operatively connect said heat film panel with the source of electrical power, and means to guide said heat film panel in a corrugated configuration, said last mentioned means including at least two support and guide members situated in spaced and parallel relationship with one another, the upper surfaces of said guide members being corrugated, said heat film panel passing over said corrugations in serpentine formation and being secured in position to said corrugations.

With the foregoing in view, and other advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

FIG. 3 is a schematic cross sectional view of an alternative embodiment particularly suited for use with an enclosure such as a hair dryer or the like.

In the drawings like characters of reference indicate corresponding parts in the different figures.

DETAILED DESCRIPTION

Figure 1:
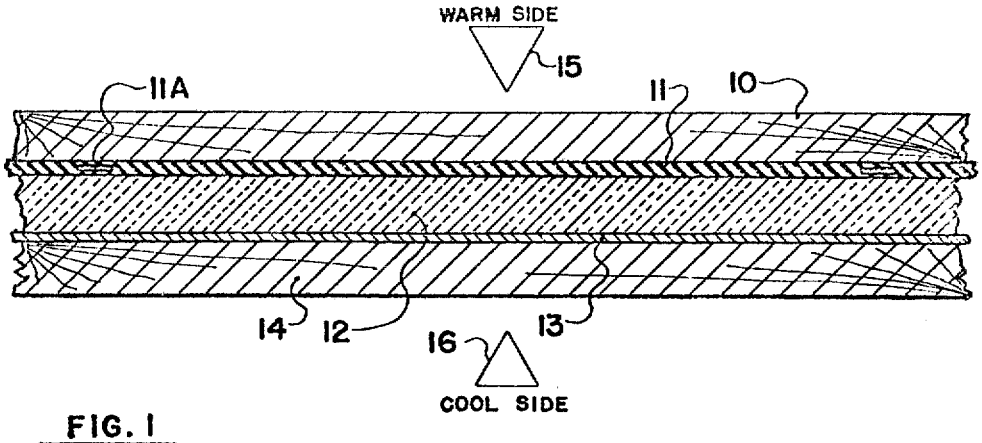
FIG. 1 shows a schematic cross sectional view of one embodiment having one warm side and one cool side.

Proceeding therefore to describe the invention in detail, reference should first be made to FIG. 1 which includes a construction having a facing material 10, a layer or panel of heat strip or film 11 on one side thereof, forming an enclosed heating element panel, insulating material 12 which may take the form of a panel, a reflector film or panel 13 and any substrate, support or facing panel 14.

The high strength polyester film 11 of low surface resistance is produced by treating one or both surfaces of a stretched polyester film of high mechanical strength with a solvent or swelling agent capable of swelling or superficially dissolving the polyester film surface, applying electroconductive particles, preferably carbon black, to the surface in a concentration corresponding to the desired surface resistance, and then subjecting the film to a heat treatment. In the case of pigments which are inert to the solvents or swelling agents employed, such as carbon black, the procedure is advantageously such that the electroconductive particles are dispersed in the solvents or swelling agents used for superficially dissolving or swelling the surface of the polyester film, the concentration of the dispersion, relative to the proportion of pigment, ranging from 0.1 to 12.0% by weight, preferably from 0.5 to 5.0%. The quantity of carbon black to be employed per square meter of the film surface ranges from 0.1 $g/m^2$ to 5.0 $g/m^2$, preferably from 0.3 $g/m^2$ to 3.0 $g/m^2$. The dispersion is applied to the film surface and the film is then subjected to a heat treatment. Preferably, the electroconductive particles are sandwiched between two layers of relatively thin, flexible polyester film laminated together and incorporating electrical conductors shown schematically by reference character 11A, adjacent each side edge in the form of metallic ribbons or strips or the like, connectable to a source of electrical energy by means of terminals 11B crimped to the ends of the ribbons or strips 11A and having conductors 11C connected to and extending from the terminals 11B (see FIG. 7).

The facing material 10 can be any material that is rigid, semi-rigid or flexible and in any thickness required and due to the heat generated by the heat strip or film, it is recommended that this facing material be manufactured from a substance approved by government regulations for the intended purpose and that the material be rated for the applicable surface temperature generated by the heat strip or film incorporated therein.

The material may be sandwiched together with the other components 11, 12, 13 and 14 and secured adhesively or by any other conventional means, or can be laid up with an air space therebetween, if desired. Examples of facing materials 10 include plastic metal or wood panelling or film, flexible or semi-rigid or rigid, or plasterboard panels and the like.

The heat generated by the heat strip or film 11 is radiated in general towards the warm side 15 firstly because of the insulation layer 12 and secondly and more importantly, because of the reflector film 13 thus giving the warm side 15 and the cool side 16 as shown.

The insulating material can be any material that is rigid, semi-rigid or flexible and includes air spaces, in any thickness designed to give the proper separation between the heat strip 11 and the reflector film 13 or other substrate used. Examples of preferred material for insulation includes spun glass fibre, rockwool, ceramic wool or other heat resistant material, foamed material and the like.

The reflector film or panel may be any material that can be efficiently utilized for the purpose intended. It has been demonstrated that the most efficient reflector film is made of aluminum or similar material and the choice of material depends upon design parameters. An excellent reflector comprises a silver or other metallic emulsion deposited on polyethylene or mylar film or the like.

The substrate or other facing panel can be any material or medium approved by the governing authorities for its intended purposes such as wood, metal, plastic, plasterboard and the like.

The construction shown in FIG. 1, if flexible can be wrapped around any container or vessel that it is required to heat and, of course, the heat is controlled by the design of the heat strip or film 11 incorporated therein, it being understood that it is connected to a source of electrical energy and controlled thermostatically by conventional means (not illustrated).

Figure 2:
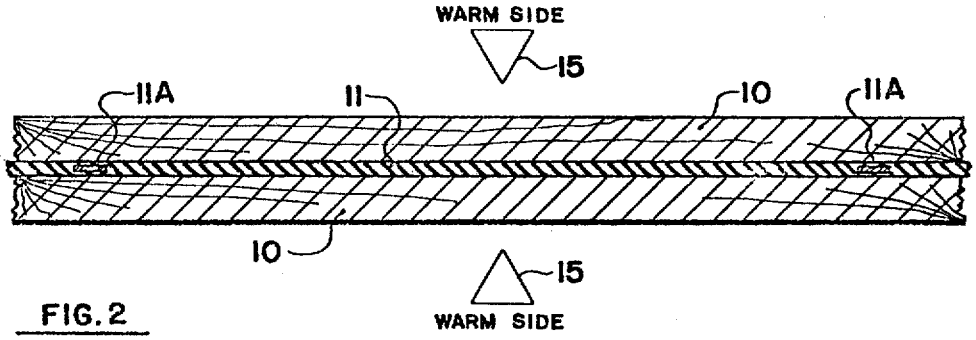
FIG. 2 is a view similar to FIG. 1 but showing an embodiment with two warm sides.

FIG. 2 shows an alternative construction in which the facing material 10 is on both sides of the heat strip or film 11 thus giving two warm sides 15, as illustrated. Once again this construction can be flexible or rigid depending upon its intended use.

Figure 3:
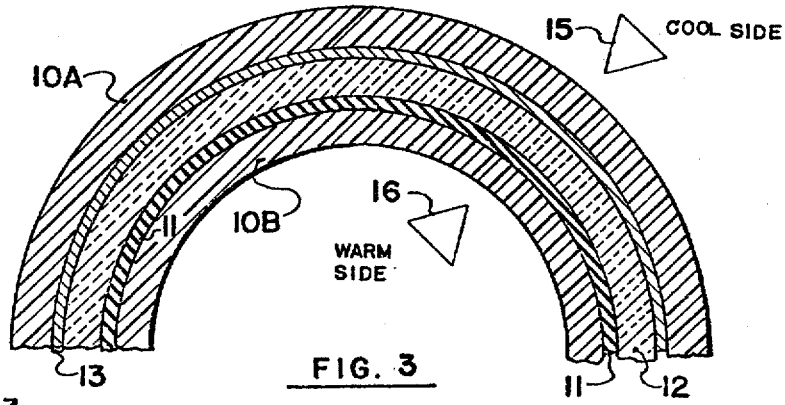

The application shown schematically in FIG. 3 includes a protective backing or facing material 10A, reflector film 13, insulating material 12, heat strip or film 11 and inner facing material 10B all of which are adhesively secured together, it being understood that the protective backing or facing material 10A is the outer side of the construction thus giving the cool side 15 on the outer side and the warm side 16 on the inner side.

The radius shown can be infinite providing it does not interfere with the safe and proper usage of the flexible heat strip or film 11 and although a curved surface is shown which is hemispherical, nevertheless it will be appreciated that the construction is applicable to any configuration and dimension desired.

This type of construction, which is preferably rigid, is ideally suited to such application as hair dryers and the like, and can be formed in a dome or hemispherical shaped helmet type configuration.

Figure 4:
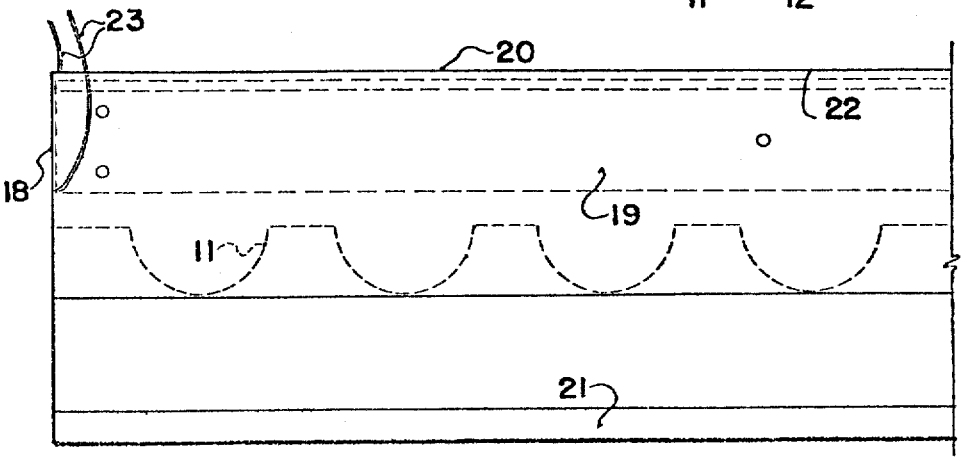
FIG. 4 is a fragmentary side elevation of a heating fixture incorporating the heat strip or film.
Figure 5:
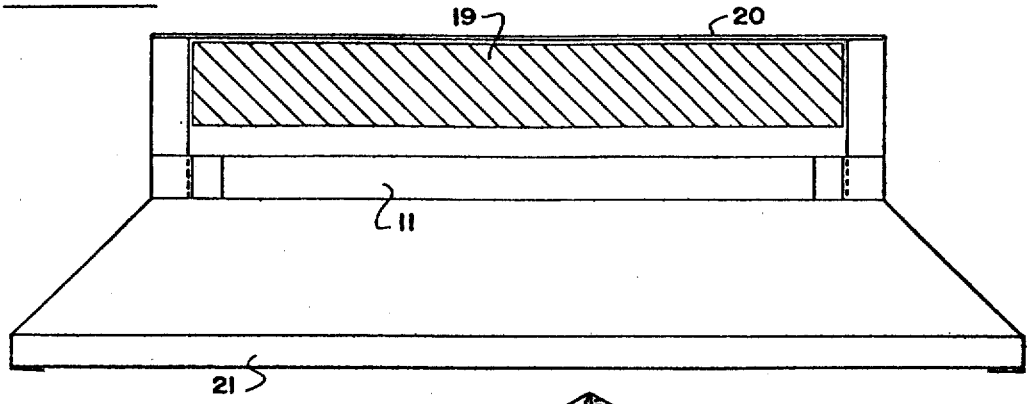
FIG. 5 is a schematic end view of FIG. 4.

FIGS. 4 and 5 show the heat strip or film 11 utilized in a ceiling or wall heating fixture which includes an elongated casing 18 in the form of a lamp fixture or the like and having rigid insulation in the form of urethane or the like 19 adjacent the inner wall with a reflector film or plate 20 on one side of the insulation 19.

The heat strip or film 11 is preferably formed in the configuration shown to give maximum effect and is situated below the insulation 19 with a plastic egg crating type panel 21 being situated on the warm side of the heat strip or film 11, it being understood that the side 22 of the fitting is the cool side. A cable 23 extends from one end and may be connected to a source of electrical energy on one side and to the heat strip or film 11 on the other.

This enables heating units to be suspended or fastened to walls wherever desired and they are particularly adapted for use with recessed ceilings with the egg crating 21 conforming with the conventional egg crating used with recessed lighting associated in the same ceiling.

Figure 6:
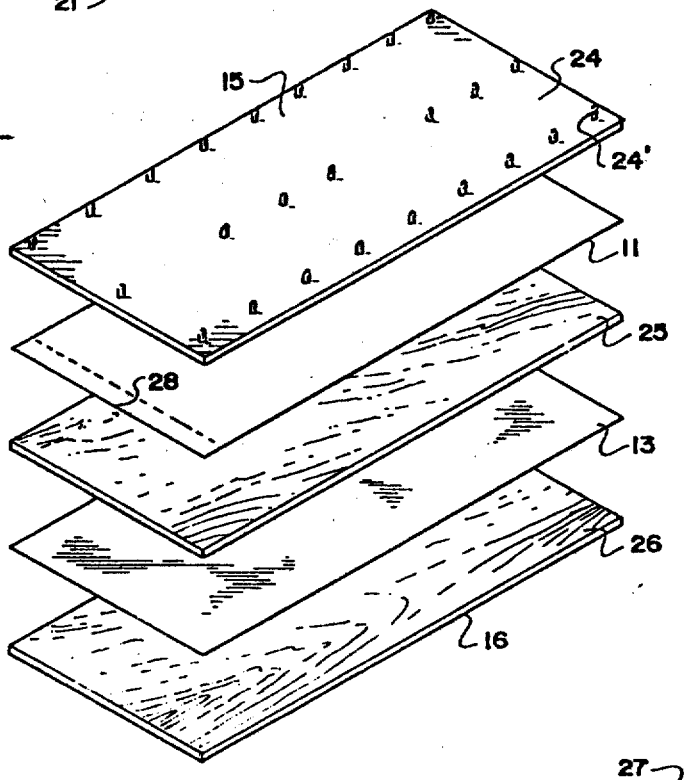
FIG. 6 is an isometric exploded view of a wall panel incorporating the heat strip or film.
Figure 7:
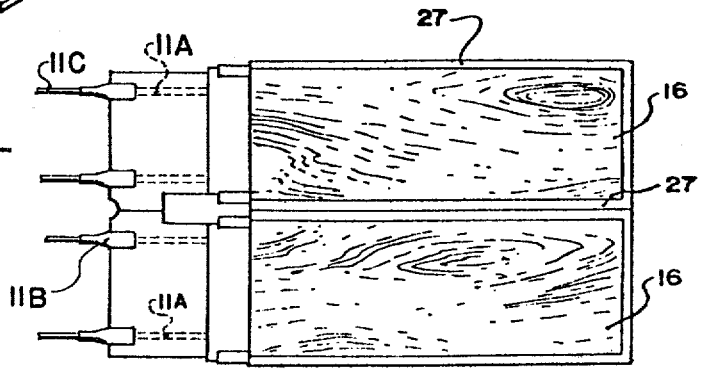
FIG. 7 is a plan view of the assembled panel of FIG. 6.

Reference should next be made to FIGS. 6 and 7 which show the construction of rigid wall panels.

In this embodiment, a quarter inch sheet of plywood 24 has a sheet of heat strip or film 11 stapled thereto by means of staples 24'. A further sheet or plywood 25 is then placed on the other side of the heat strip, a sheet of aluminium reflector material 13 is placed against the other side of the plywood 25 and finally a further sheet of plywood 26 is placed against the other side of the reflector film 13. These are sandwiched together and held by means of adhesive or any other conventional means with the edges taped by means of a plastic tape 27 extending around three sides of the sandwich as shown in FIG. 7.

Figure 9:
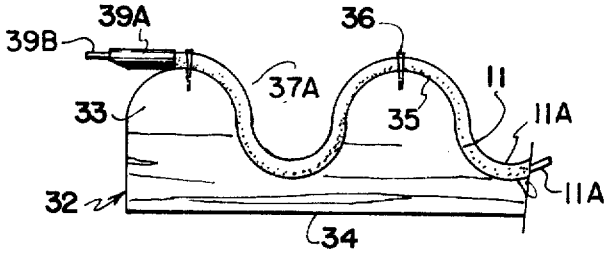
FIG. 9 is a fragmentary side view of one of the guide members with a portion of the flexible heating film secured within the corrugations.

It will be observed that one end 28 of the heat strip or film 11 extends beyond the wall panel construction and is utilized for connecting the heat strip or film to a source of electrical energy as shown schematically in FIG. 9 which shows two panels in side by side relationship. This provides a wall panel having a warm side 15 and a cooling side 16.

FIGS. 8 to 12 illustrate the preferred embodiment of the invention.

In this embodiment, a substantially rectangular facing panel 29 is illustrated which may be made from any desired material such as plywood, plasterboard or the like and is preferably rigid.

A reflective sheet 30 is secured to the inner face of panel 29 by adhesive or some similar means, said reflective sheet being similar to the reflective sheet hereinbefore described.

Next an insulating panel 31 is secured as by adhesive or the like to the reflective sheet 30, said insulated panel preferably being rigid and being formed from an insulating material as hereinbefore described.

Figure 8:
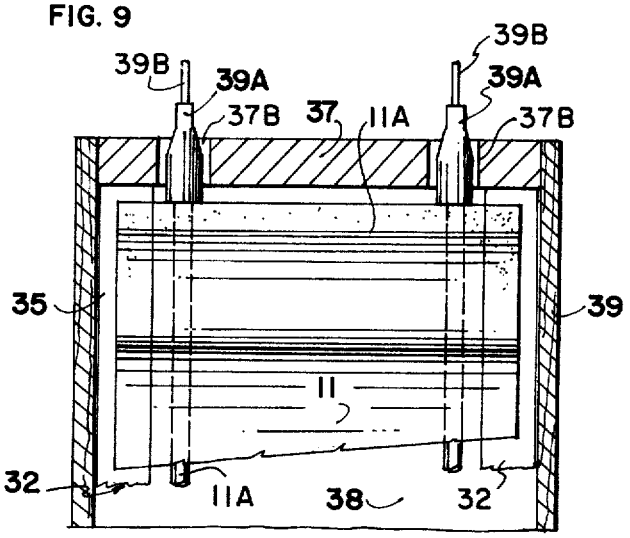
FIG. 8 is a fragmentary top plan view of a panel assembly separated substantially along the line 8—8 of FIG. 10.

A pair of spaced and parallel situated support and guide members are next provided, said members being collectively designated 32 (these are shown in FIG. 8).

Figure 12:
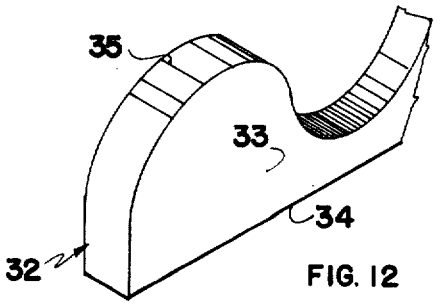
FIG. 12 is a fragmentary isometric view of one of the corrugated guide members.

These may be formed from wood or plastic and are elongated strips 33 having a substantially planar one edge 34 and a corrugated or alternatively curved upper edge 35 as clearly shown in FIGS. 9 and 12.

The aforementioned plastic heat film panel 11 is laid between the spaced and parallel guides 33 and engaged with the matching corrugations 35 and it may be stapled in position as illustrated by staples 36 so that it follows the corrugations as shown in FIG. 9. These guide members 32 are situated adjacent each of two spaced and parallel edges of the assembly and, if necessary, spacer strips 37 may be secured to opposite edges of the glass fibre blanket panel 31 perpendicular to the guide strips or members 32 thus defining a space 37A between the inner surface 31A of the panel 31, and the corrugated surface 11A of the flexible heat panel 11.

Finally a further facing panel 38 may be secured as by adhesive or the like, to the under surfaces 34 of the guide strips 32 and to the under surfaces 37B of spacer strips 37.

If desired, edge strips 39 may be secured as by adhesive or the like around all four edges of the assembled panel and contacts 39A with terminal pins 39B extending from the heat strip or film 11, extend through grooves 37B in the spacers 37 for connection to a source of electrical energy.

Figure 10:
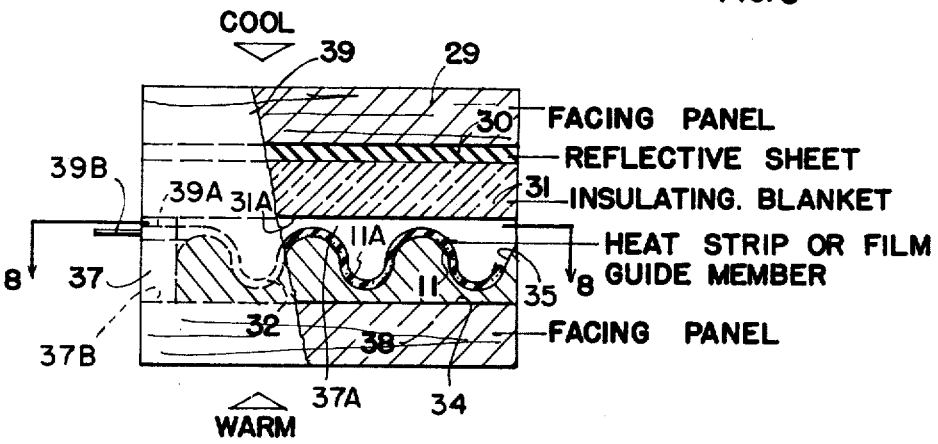
FIG. 10 is a partially broken away fragmentary cross sectional view of the preferred embodiment of the invention.
Figure 11:
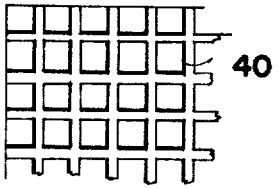
FIG. 11 is a fragmentary plan view of one embodiment of a grid which may be used as a facing panel.

This assembled wall panel component, as illustrated in FIG. 10, includes a cool side at facing panel 29 and a warm side at facing panel 38. They may be used as wall panels or ceiling panels and, if desired, may be formed with an open grid facing panel 40 in place of panel 38 so that they can be formed similar to light fixtures and placed in the ceiling to direct heat downwardly through the open grid 40.

The forming of the heat panel or strip 11 in a corrugated configuration, sealed within the panel assembly, gives a greater area of heating medium for a specified planar area.

The corrugation dimensions for the guide members 32 can vary according to design parameters and the radius of curvature of the heating film or strip 11 depends upon the construction of the film but should ensure that the safe and proper usage of the film is not interrupted.

It will of course be appreciated that, if desired, the reflective sheet 30 and the glass fibre blanket may be eliminated if two warm sides are required for the finished panel.

The various constructions can be utilized under a variety of conditions and for a considerable variety of uses.

Given below is a partial list of the uses to which the various constructions can be placed, in order to supply controlled heat to the item with which it is used, but it is to be understood that this list is not meant to be limited:

RAILWAYS

Marshalling yard oil stands
Switches
Oil storage tanks
Tar storage tanks
Oil transportation tank cars
Sulphur transportation tank cars
Chemical transportation tank cars
Aircraft—snowmobiles and tractor heating
Woodchip transportation Goldola cars
Coal transportation Gondola cars
Gravel transportation Gondola cars
Ore transportation Goldola cars
Heated Cars for provisions, fruit, canned goods and vegetable transportation
Plenums

COMMERCIAL

Buses
Perishable food transport trucks
Oil tank trucks
Warehouse heating
Office heating
Automobile and truck heating
Market gardener greenhouses and cold frames
Piggy barns
Dairy barns
Poultry barns
Beehives
Mining—underground tunnels, eating rooms, water-lines (all types)
Surface—water-lines
Trenching and excavations
Heating for shops, garages, stores, stadiums and arenas
Northern installations (N.O.R.A.D.)
Grain elevators
Grain dryers
Airport runways
Use in cooking equipment
Ovens
Grills
Fryers
Dishwasher heaters
Plate and food warmers
Steam cooking equipment
Coffee making equipment
Food processing of all types
All industries requiring heating and/or drying processing
Water heating
Auto batteries
Engines
Seats

DOMESTIC

Blankets for all types of heat
Home heating
Mobile trailer homes
Travel trailers
Campers
Heat fixtures
Baseboard heat
Hair dryers
Motel and hotel rooms
Ceiling heat
Wallboard heat
Under floor heating
Wall picture heaters
Solarium heating
Crib heating for premature babies
Stadium heating
All types of space heating including furnaces and boilers.

MEDICAL

Bed warmers
Body warmers
Therapeutic equipment

Although the flexible and rigid embodiments have been mentioned as being used for different purposes as specified above, nevertheless it will be appreciated that the constructions described can be interchanged so far as usage is concerned, depending upon design parameters.

Since various modifications can be made in my invention as hereinbefore described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A heating assembly for use with a source of electrical power and comprising in combination a panel construction including an insulated heat film panel and a facing material panel on one side thereof, means to operatively connect said heat film panel with the source of electrical power, and means to guide said heat film panel in a corrugated configuration, said last mentioned means including at least two support and guide members situated in spaced and parallel relationship with one another upon said facing material panel, the upper surfaces of said guide members being corrugated, said heat film panel passing over said corrugations in serpentine formation and being secured in position to said corrugations, spacer means on said facing material panel, and a further facing material panel on the other side of said heat film panel, said spacer means maintaining said facing panels apart and defining an air space between said corrugated heat film panel and the underside of said further facing material panel.

2. The assembly according to claim 1 which includes an insulating panel on one side of said heat film panel.

3. The assembly according to claim 2 which includes a heat reflecting sheet between said facing material panel and said insulating panel.

4. The assembly according to claim 1, 2 or 3 in which said assembly includes at least one rigid facing material panel whereby said heating assembly is rigid.

5. The assembly according to claim 2 in which the facing panel remote from said insulating panel is in the form of an open grid.

6. The assembly according to claim 3 in which the facing panel remote from said insulating panel is in the form of an open grid.

7. The assembly according to claim 1, 2 or 3 which includes a rigid facing panel, a heat reflective sheet secured to the inner surface thereof, a rigid insulating sheet secured to said heat reflecting sheet, said spacer means being situated along opposite parallel sides of said facing material panel, said guide members extending perpendicularly between adjacent the ends of said spacer means.

8. The assembly according to claim 5 or 6 which includes a rigid facing panel, a heat reflective sheet secured to the inner surface thereof, a rigid insulating sheet secured to said heat reflecting sheet, said spacer means being situated along opposite parallel sides of said insulating sheet, said guide members extending perpendicularly between adjacent the ends of said spacer means.

* * * * *